US010161287B2

(12) United States Patent
Hwang

(10) Patent No.: US 10,161,287 B2
(45) Date of Patent: Dec. 25, 2018

(54) EXHAUST PIPE STRUCTURE HAVING VARIABLE CONFLUENCE PORTION

(71) Applicant: Hyundai Motor Company, Seoul (KR)

(72) Inventor: Dae-Gil Hwang, Suwon-si (KR)

(73) Assignee: Hyundai Motor Company, Seoul (KR)

( * ) Notice: Subject to any disclaimer, the term of this patent is extended or adjusted under 35 U.S.C. 154(b) by 27 days.

(21) Appl. No.: 15/366,979

(22) Filed: Dec. 1, 2016

(65) Prior Publication Data

US 2017/0362990 A1 Dec. 21, 2017

(30) Foreign Application Priority Data

Jun. 20, 2016 (KR) ..... 10-2016-0076398

(51) Int. Cl.
*F01N 1/00* (2006.01)
*F01N 13/08* (2010.01)

(52) U.S. Cl.
CPC ..... *F01N 13/08* (2013.01)

(58) Field of Classification Search
USPC ..... 60/274, 287, 288, 289, 291, 292, 312, 60/313, 314, 324
See application file for complete search history.

(56) References Cited

U.S. PATENT DOCUMENTS 7,640,728 B2 * 1/2010 Yoshizaki ..... B01D 53/9431 60/286
7,703,574 B2 * 4/2010 Kruger ..... F01N 13/02 181/253
8,256,214 B2 * 9/2012 Rioli ..... F02D 17/02 123/90.15
8,826,651 B2 * 9/2014 Laube ..... F01N 1/166 181/211
8,893,479 B2 * 11/2014 Togashi ..... F01N 1/165 123/320
9,359,935 B2 * 6/2016 Breuer ..... F02B 33/00
9,435,242 B2 * 9/2016 Kopp ..... F01N 3/0814
2005/0056010 A1 * 3/2005 Momosaki ..... F01N 13/10 60/312

FOREIGN PATENT DOCUMENTS

| | | | |
|---|---|---|---|
| JP | 7-9187 | B2 | 2/1995 |
| JP | 2006-57553 | A | 3/2006 |
| JP | 2008-101517 | A | 5/2008 |
| JP | 2011-127450 | A | 6/2011 |
| JP | 4715573 | B2 | 7/2011 |
| KR | 10-0957325 | B1 | 5/2010 |

* cited by examiner

*Primary Examiner* — Binh Q Tran
(74) *Attorney, Agent, or Firm* — Morgan, Lewis & Bockius LLP

(57) ABSTRACT

An exhaust pipe structure having a variable confluence portion may include a first pipe to discharge exhaust gas generated by engine cylinders disposed in a first line, a second pipe to discharge exhaust gas generated by engine cylinders disposed in a second line, a confluence pipe provided with a first end connected to the first pipe for communication with the first pipe and a second end connected to the second pipe for communication with the second pipe, and a valve plate disposed in the confluence pipe and selectively opened and closed, in which the confluence pipe may include a main connection tube disposed at the first end of the confluence pipe and an entry confluence tube and a sub-entry confluence tube branched off from a middle of the confluence pipe and disposed at the second end of the confluence pipe.

5 Claims, 6 Drawing Sheets

EXHAUST PIPE STRUCTURE HAVING VARIABLE CONFLUENCE PORTION

CROSS-REFERENCE TO RELATED APPLICATION

The present application claims priority to Korean Patent Application No. 10-2016-0076398, filed Jun. 20, 2016, the entire contents of which is incorporated herein for all purposes by this reference.

BACKGROUND OF THE INVENTION

Field of the Invention

The present invention relates to an exhaust pipe structure for vehicles which emits exhaust gas generated by an engine to a rear part of a vehicle frame, and more particularly, to an exhaust pipe structure having a variable confluence portion which may maintain silence or generate an exhaust sound of emphasizing dynamics according to driving conditions or driver preferences.

Description of Related Art

Engines may be classified into an in-line 4-cylinder engine, an in-line 6-cylinder engine, a V-type 6-cylinder engine, a V-type 8 cylinder engine, etc. according to numbers and arrangement types of cylinders, and may further be classified into a longitudinal mount-type engine and a transversal mount-type engine according to whether or not an engine is arranged in the length direction or the width direction of a vehicle frame.

Among the aforementioned, a longitudinal mount-type V-type 6-cylinder engine is configured such that an exhaust pipe connected to cylinders in the left line and an exhaust pipe connected to cylinders in the right line may be joined at a midway point, and an exhaust sound tone of the engine varies according to the positions and shapes of such a confluence.

That is, in the case of a 6-cylinder engine having 6 cylinders, a fundamental frequency includes a third order and orders of multiples of 3. However, it is well known from actual analysis that there are half-orders, such as a $1.5^{th}$ order and a $4.5^{th}$ order.

It is known that such half-orders are main factors to determine an exhaust soundtone of a vehicle and are caused by, for example, change of exhaust timing of an engine or imbalance of an intake or exhaust runner length.

For reference, frequency analysis of a sound generated by an engine is executed by analyzing the number of an order set as one event whenever a crank shaft rotates, and a fundamental frequency of an exhaust sound varies according to the RPM and order of the engine (in the case of a rotating body in which a vibration frequency varies according to engine RPM, if a general frequency analysis method is used, the vibration frequency is frequently changed according to engine RPM. Therefore, since it is difficult to determine reasons for vibration and to solve problems only using the frequency analysis method, an order analysis method, in which vibration components interlocked with RPM are non-dimensionalized with an input RPM causing vibration, is widely used in a vibration system in which RPM is frequently changed and thus a vibration frequency is changed. That is, if the input RPM is always measured and expressed as a first order and vibration interlocked with the input RPM is expressed as order components (multiples, orders, etc.), components interlocked with the input RPM may be expressed as constant order components regardless of the input RPM).

An exhaust sound, in which many half order components H1.5, H4.5, etc. . . . are expressed, has a rough tone. A vehicle requiring silence is set such that these half order components are reduced, but a high-performance vehicle setting a goal of maximization of driving performance has improved marketability through emission of a rough exhaust sound.

In a conventional exhaust pipe structure which is mainly mounted in large-scale vehicles and regards silence as important, as shown in FIG. 1A, a confluence portion 4 is provided to connect a left exhaust pipe 1 and a right exhaust pipe 2 at sub-mufflers 3*a* and 3*b* thereof (so as to join exhaust gas flowing in the left exhaust pipe 1 and exhaust gas flowing in the right exhaust pipe 2) and weakens all sections of half orders, thereby increasing silence of an exhaust sound.

However, such a structure may not appeal to consumers preferring a rough exhaust sound and thus development of an exhaust pipe structure, in which half orders may be emphasized according to driving conditions, is required.

Further, the above-described conventional structure in which heavy mufflers 6*a* and 6*b* having a long mounting length in the lateral direction are mounted is very weak to vibration and thus a reinforcement bracket 5 to improve a vibration mode is additionally mounted. That is, since unnecessary behavior of the mufflers 6*a* and 6*b* in the vertical direction and the lateral direction may occur, as exemplarily shown in FIG. 1B, if the mufflers 6*a* and 6*b* are vibrated together with excited vibration of an engine, vibration of the mufflers 6*a* and 6*b* in the vertical direction and the lateral direction is excessively increased and, thus, vibration of a vehicle frame is increased and a booming sound may be generated. In order to improve such vibration problem, mounting of a support traversing the left exhaust pipe 1 and the right exhaust pipe 2 is additionally required and the reinforcement bracket 5 was conventionally mounted as such a support.

The methods and apparatuses of the present invention have other features and advantages which will be apparent from or are set forth in more detail in the accompanying drawings, which are incorporated herein, and the following Detailed Description, which together serve to explain certain principles of the present invention.

BRIEF SUMMARY

Various aspects of the present invention are directed to providing an exhaust pipe structure having a variable confluence portion which may maintain silence or generate an exhaust sound of emphasizing dynamics according to driving conditions or driver preferences and does not require mounting of an additional reinforcement bracket.

According to various aspects of the present invention, an exhaust pipe structure having a variable confluence portion may include a first pipe to discharge exhaust gas generated by engine cylinders disposed in a first line, a second pipe to discharge exhaust gas generated by engine cylinders disposed in a second line, a confluence pipe provided with a first end connected to the first pipe for communication with the first pipe and a second end connected to the second pipe for communication with the second pipe, and a valve plate disposed in the confluence pipe and selectively opened and closed, in which the confluence pipe may include a main connection tube disposed at the first end of the confluence pipe and an entry confluence tube and a sub-entry confluence tube branched off from a middle of the confluence pipe and disposed at the second end of the confluence pipe.

The valve plate may have a disc shape and may be configured to select one of the entry confluence tube and the sub-entry confluence tube as a path of the confluence pipe according to a rotated angle of the valve plate around a rotary shaft.

The valve plate may have a disc shape and may be configured to open or close the confluence pipe according to a rotated angle of the valve plate around a rotary shaft.

The exhaust pipe structure may further include an actuator configured to rotate the valve plate when power is applied to the actuator.

The actuator may determine whether or not the valve plate is opened or closed by a logic predetermined according to driving information of a vehicle and then may rotate the valve plate to open or close the confluence pipe.

The actuator may rotate the valve plate to close an inside of the confluence pipe, in a first condition in which an engine is rotated at a low speed within a first rotation range, or in a second condition in which the engine is rotated at a high speed within a second rotation range and an engine load is high within a first load range.

The actuator may rotate the valve plate to open the entry confluence tube, in a third condition in which an engine is rotated at a constant speed within a third rotation range and an engine load is low within a second load range.

The actuator may rotate the valve plate to open the sub-entry confluence tube, in a fourth condition in which an engine is rotated at a constant speed within a third rotation range and an engine load is high within a third load range, or in a fifth condition in which the engine is rotated at a high speed within a second rotation range and an engine load is low within a fourth load range.

The first pipe and the second pipe may each have sections disposed in parallel in front of mufflers, and the confluence pipe may be disposed at the parallel sections of the first and second pipes.

It is understood that the term "vehicle" or "vehicular" or other similar terms as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, plug-in hybrid electric vehicles, hydrogen-powered vehicles and other alternative fuel vehicles (e.g., fuel derived from resources other than petroleum). As referred to herein, a hybrid vehicle is a vehicle that has two or more sources of power, for example, both gasoline-powered and electric-powered vehicles.

The methods and apparatuses of the present invention have other features and advantages which will be apparent from or are set forth in more detail in the accompanying drawings, which are incorporated herein, and the following Detailed Description, which together serve to explain certain principles of the present invention.

It should be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particular intended application and use environment.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that the present description is not intended to limit the invention(s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

Various embodiments of the present invention relate to an exhaust pipe structure which maintains silence or generates an exhaust sound of emphasizing dynamics according to driving conditions or driver tastes.

Figure 1A:
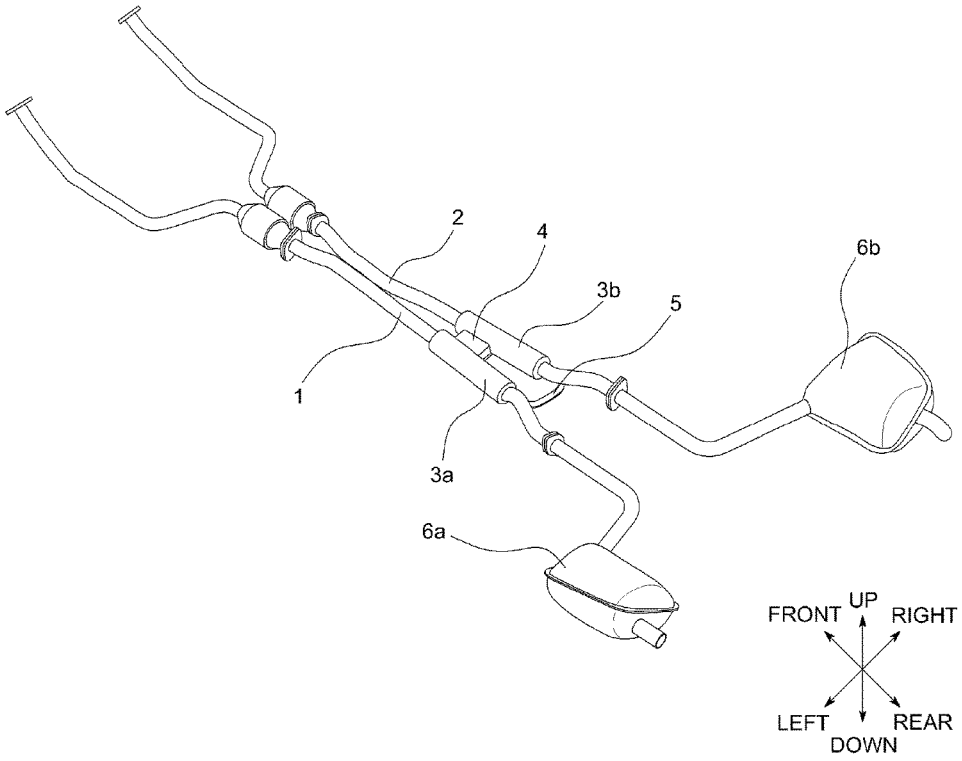
FIG. 1A (PRIOR ART)
FIG. 1A is a perspective view illustrating a conventional exhaust pipe stricture.
Figure 1B:
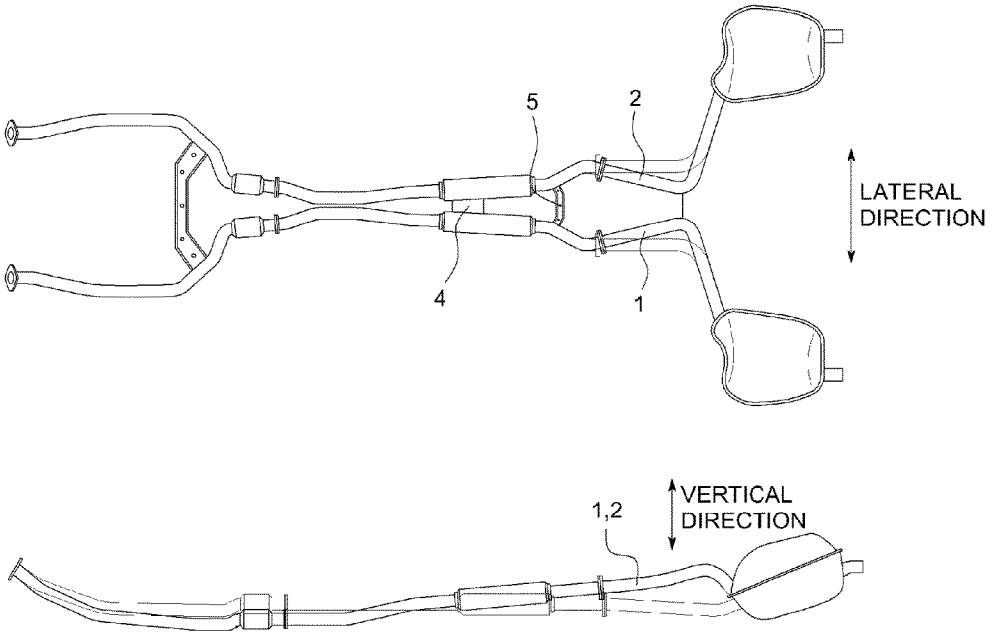
FIG. 1B (PRIOR ART)
FIG. 1B is a view illustrating behavior of the conventional exhaust pipe structure near mufflers in the vertical direction and in the horizontal direction.
Figure 2A:
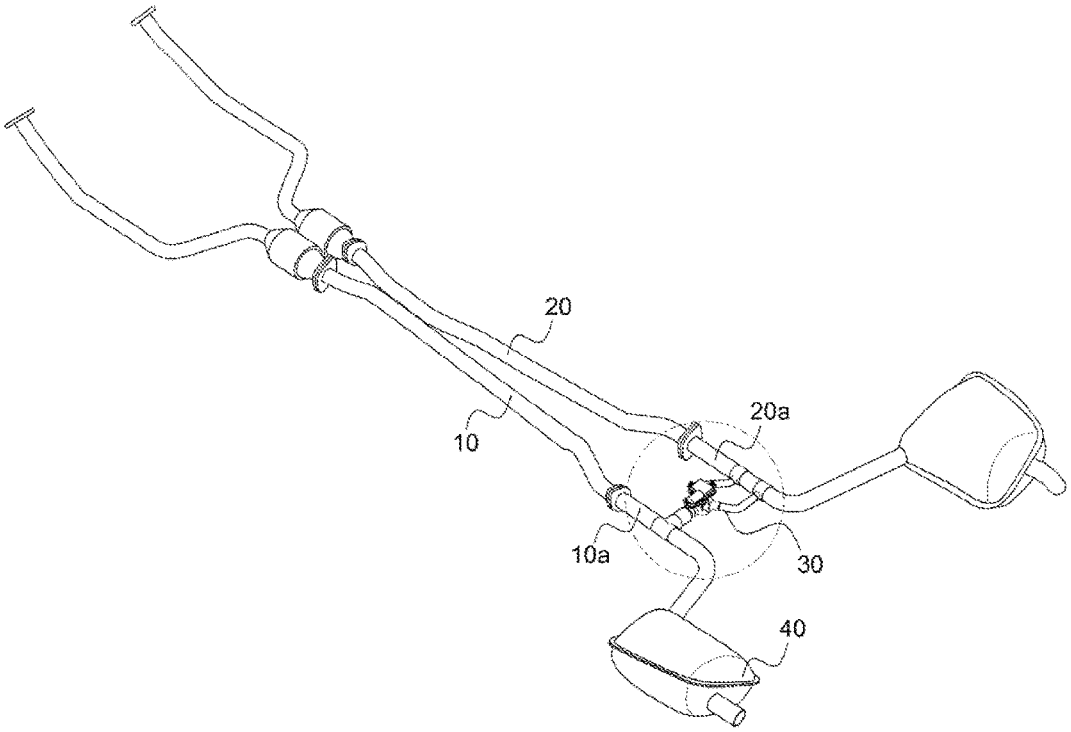
FIG. 2A and FIG. 2B are views illustrating an exhaust pipe structure in accordance with various embodiments of the present invention and an enlarged view of a portion of the exhaust pipe structure on which a confluence pipe is mounted.
Figure 2B:
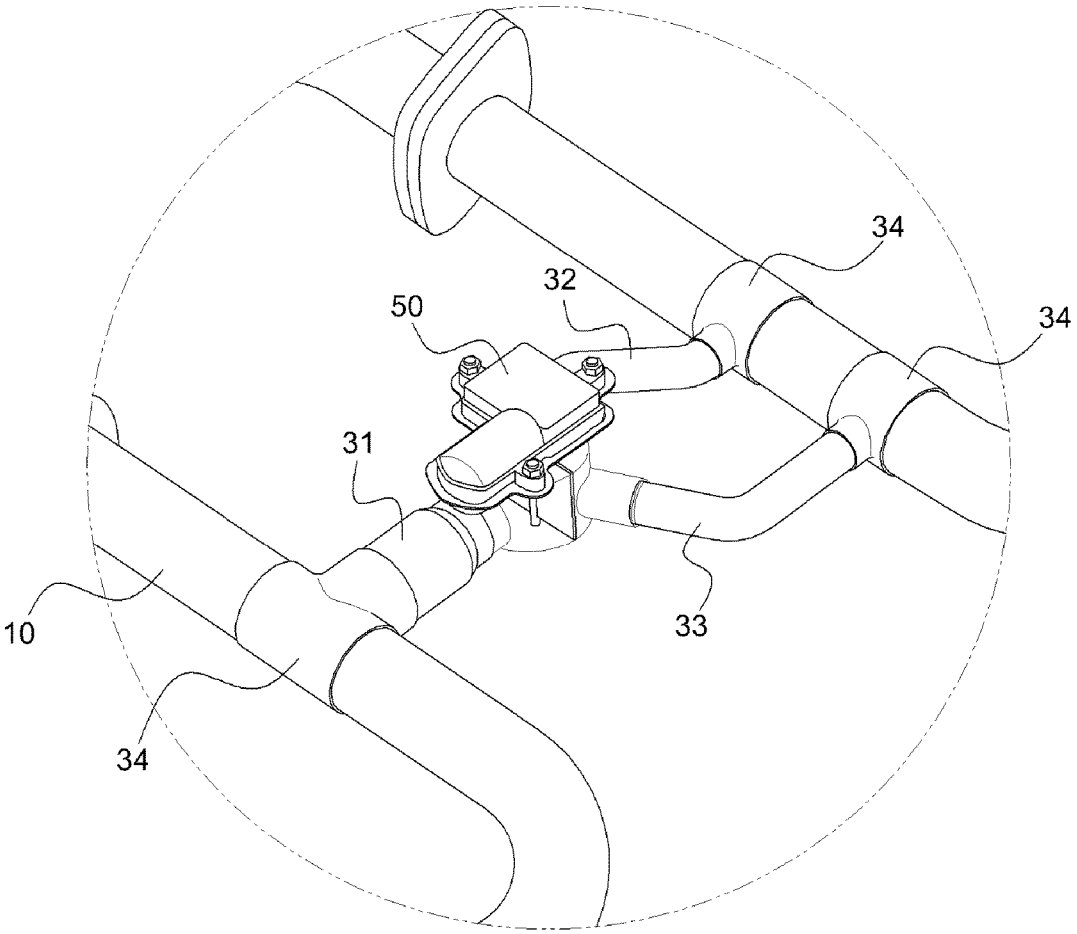

As illustrated in FIGS. 2A and 2B, in an exhaust pipe structure of various embodiments of the present invention, a first pipe 10 to discharge exhaust gas generated by engine cylinders arranged in one line and a second pipe 20 to discharge exhaust gas generated by engine cylinders arranged in the other line are arranged in parallel in the length direction and are connected through a confluence pipe 30.

In various embodiments, the confluence pipe 30 has a Y shape in which a main connection tube 31 is disposed at one end of the confluence pipe 30 and an entry confluence tube 32 and a sub-entry confluence tube 33 are branched off from the middle part of the confluence pipe 30 and disposed at the other end of the confluence pipe 30.

Figure 3:
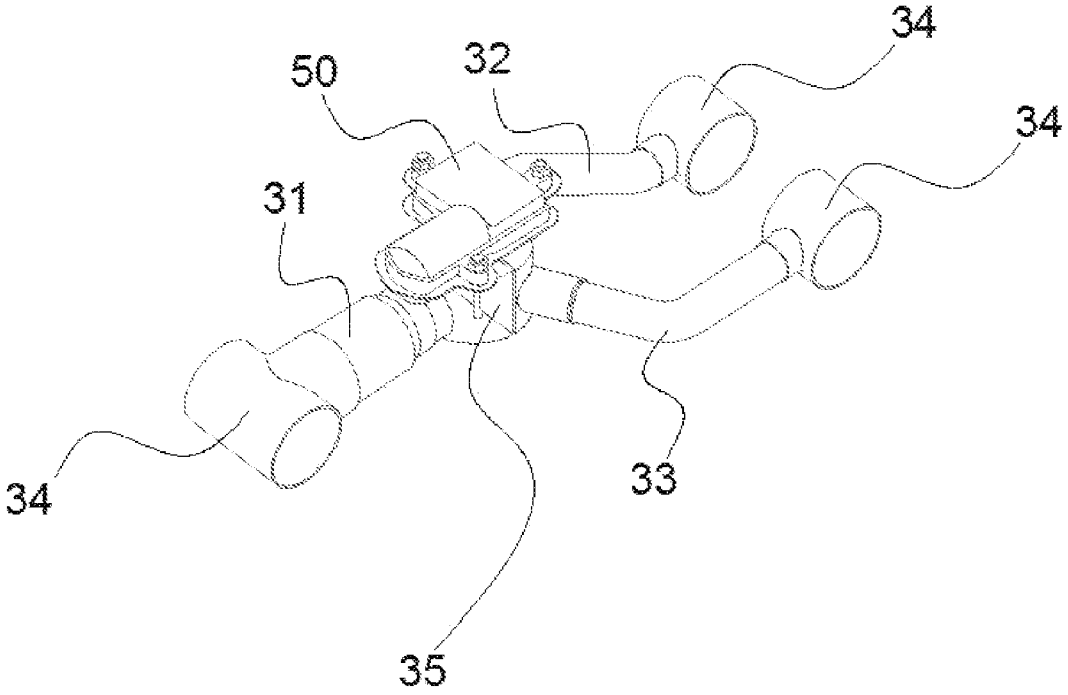
FIG. 3 is a perspective view of the confluence pipe in accordance with the embodiment of the present invention, illustrating a valve plate installed in the confluence pipe.

Therefore, the confluence pipe 30 is configured such that the main connection tube 31 arranged at one end of the confluence pipe 30 is connected to the first pipe 10 so as to communicate with the first pipe 10 and the entry confluence tube 32 and the sub-entry confluence tube 33 arranged at the other end of the confluence pipe 30 are connected to the second pipe 20 so as to communicate with the second pipe 20, and a valve plate 35 which is opened or closed is installed in the confluence pipe 30, as exemplarily shown in FIG. 3. Here, the confluence pipe 30 is connected to the first pipe 10 and the second pipe 20 by confluence chamber brackets 34.

Further, when the entry confluence tube 32 and the sub-entry confluence tube 33 are connected to the second pipe 20, a connection position of the entry confluence tube 32 to the second pipe 20 is located closer to the front end of the second pipe 20 (the engine side) than a connection position of the sub-entry confluence tube 33 to the second pipe 20. In various embodiments, the connection position of the entry confluence tube 32 to the second pipe 20 is the same as a connection position of the main connection tube 31 to the first pipe 10.

In various embodiments of the present invention, respective portions of the confluence pipe 30 have a cylindrical shape, and the valve plate 35 has a disc shape having a diameter which may select one of the entry confluence tube 32 and the sub-entry confluence tube 33 as a path of the confluence pipe 30 or close the inside of the confluence pipe 30, and is opened or closed according to a rotated angle of the valve plate 35 around a rotary shaft.

When power is applied, the valve plate 35 is combined with an actuator 50 rotated by a motor installed therein. The actuator 50 may be set to judge whether or not the valve plate 35 is opened or closed by a logic predetermined according to driving information of a vehicle and then to rotate the valve plate 35 to be opened or closed.

Figures 4A, 4B, 4C:
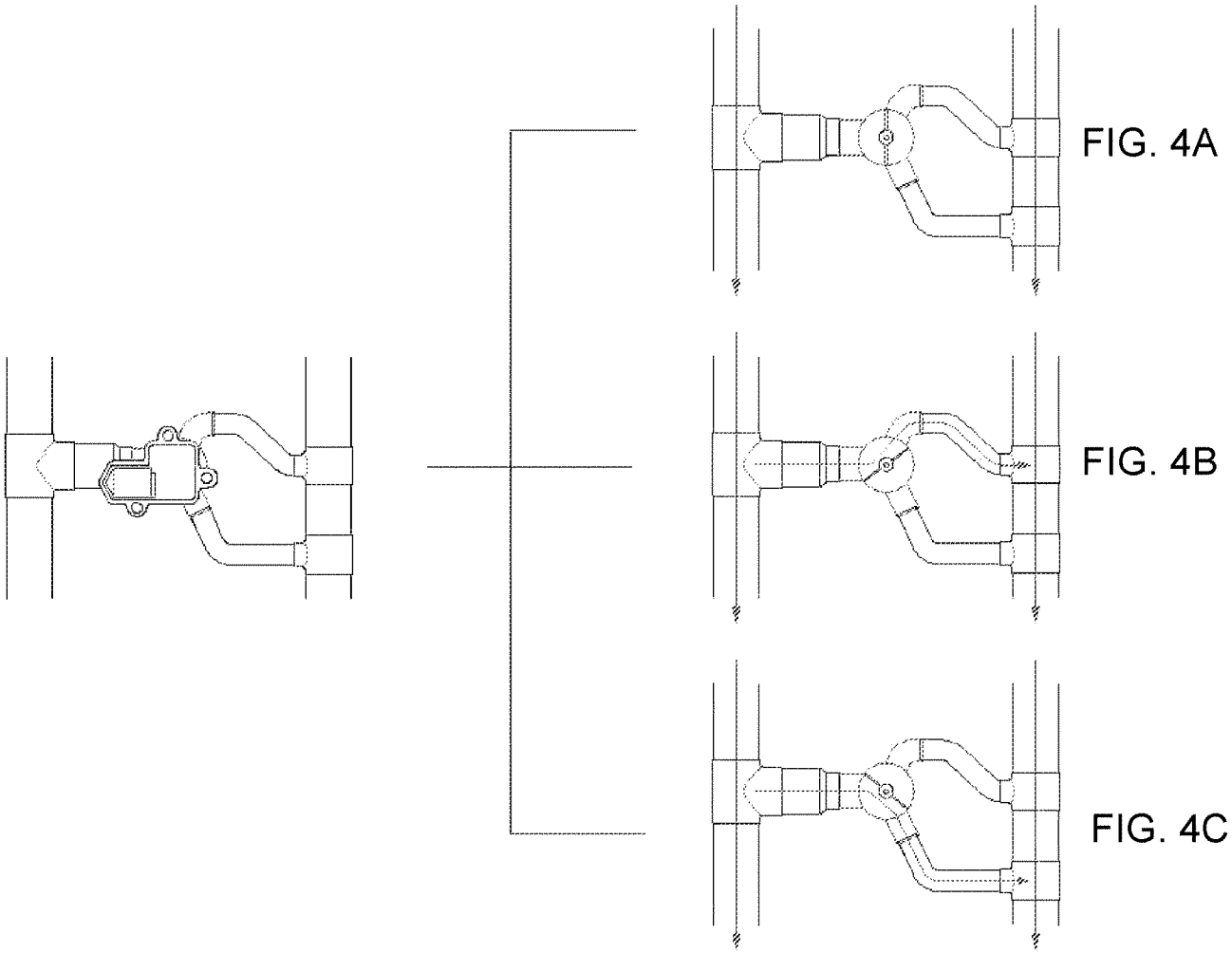
FIG. 4A, FIG. 4B, and FIG. 4C are views illustrating paths of the confluence pipe, generated by control of the valve plate by an actuator.

In various embodiments of the present invention, the logic to control the valve plate 35 by the actuator 50 is executed as below. FIGS. 4A to 4C are views illustrating paths of the confluence pipe, generated by control of the valve plate by the actuator.

In the case of a first condition that an engine is rotated at a very low speed of 750 RPM or lower (within a first rotation range), or a second condition that the engine is rotated at a very high speed of 3000 RPM or higher (within a second rotation range) and an engine load is the maximum load, i.e., 75% or higher (within a first load range) (for example, just before idle-start), the actuator 50 may set the valve plate 35 to close the inside of the confluence pipe 30 so as to generate a very rough exhaust sound (to emphasize half-order components). In this case, an exhaust sound of a 3-cylinder engine may be generated as the exhaust sound (in FIG. 4A).

In the case of a third condition where the engine is rotated at a constant speed of 750 RPM to 3000 RPM (within a third rotation range) and the engine load is lower than 50% (within a second load range) (for example, constant speed/low speed/low load/city driving modes), the actuator 50 may set the valve plate 35 to open the entry confluence tube 32 so as to generate a silent exhaust sound (to emphasize a main order component). In this case, an exhaust sound of a 6-cylinder engine may be generated as the exhaust sound (in FIG. 4B).

In the case of a fourth condition that the engine is rotated at a constant speed of 750 RPM to 3000 RPM (within the third rotation range) and the engine load is 50% or higher (within a third load range), or a fifth condition that the engine is rotated at a very high speed of 3000 RPM or higher (within the second rotation range) and the engine load is 75% or lower (within a fourth load range) (for example, high speed/acceleration and deceleration/high load/highway driving modes), the actuator 50 may set the valve plate 35 to open the sub-entry confluence tube 33 so as to generate a sufficiently dynamic exhaust sound (to emphasize various order components). In this case, a sufficiently tuning sound may be generated as the exhaust sound (in FIG. 4C).

The above-described logic explains setting in accordance with various embodiments of the present invention, and the various embodiments of the present invention are not limited to this setting. That is, separately from the above-described setting, a rough exhaust sound or a silent exhaust sound may be generated at all times or only under specific conditions according to driver preferences.

In various embodiments of the present invention, when the engine is rotated at a low speed, the valve plate 35 is opened, exhaust gas from the first pipe 10 and exhaust gas from the second pipe 20 are joined at the confluence pipe 30, half orders are weakened and thus an exhaust sound is silenced, as in the conventional structure. When the engine is rotated at a high speed, the valve plate 35 closes the confluence pipe 30, exhaust gas from the first pipe 10 and exhaust gas from the second pipe 20 are cut off (weakening of half orders is prevented differently from the conventional structure) and thus a rough and dynamic exhaust sound is generated.

Further, the confluence pipe 30 of various embodiments of the present invention connects the first pipe 10 and the second pipe 20 while supporting the first pipe 10 and the second pipe 20, thus increasing torsional stiffness instead of a conventional reinforcement bracket.

The actuator 50 to control the valve plate 35 may be operated by a predetermined logic, thus generating various exhaust sounds according to vehicle characteristics or modes operated by a driver.

In various embodiments of the present invention, as exemplarily shown in FIGS. 2A and 2B, the first pipe 10 and the second pipe 20 respectively have sections 10*a* and 20*a*, which are arranged in parallel in front of mufflers 40, and the confluence pipe 30 is disposed at the sections 10*a* and 20*a* of the first and second pipes 10 and 20.

As is apparent from the above description, an exhaust pipe structure having a variable confluence portion in accordance with various embodiments of the present invention provides characteristic effects, as below.

The exhaust pipe structure of various embodiments of the present invention adjusts communication between a first pipe and a second pipe according to driving conditions of a vehicle or driver intentions and may thus silence an exhaust sound or generate a dynamic exhaust sound, thereby increasing marketability of the vehicle.

A confluence pipe of the exhaust pipe structure various embodiments of the present invention is mounted at a position where a conventional reinforcement bracket to improve a vibration mode is disposed (i.e., a section in which the first and second pipes are parallel to each other between mufflers and sub-mufflers), thus being capable of replacing the reinforcement bracket.

An actuator to control a valve plate is operated by a predetermined logic and thus various exhaust sounds may be generated according to vehicle characteristics or modes operated by the driver.

For convenience in explanation and accurate definition in the appended claims, the terms "upper" or "lower", "inner" or "outer" and etc. are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. An exhaust pipe structure having a variable confluence portion, the exhaust pipe structure comprising:

a first pipe discharging exhaust gas generated by engine cylinders disposed in a first line;

a second pipe discharging exhaust gas generated by engine cylinders disposed in a second line;

a confluence pipe provided with a first end connected to the first pipe for fluidic communication with the first pipe and a second end connected to the second pipe for fluidic communication with the second pipe; and a valve plate disposed in the confluence pipe and selectively opened and closed, wherein the confluence pipe includes a main connection tube disposed at the first end of the confluence pipe and an entry confluence tube and a sub-entry confluence tube branched off from a middle portion of the confluence pipe and disposed at the second end of the confluence pipe; and an actuator configured to rotate the valve plate when power is applied to the actuator, wherein the valve plate has a disc shape and is configured to open or close the confluence pipe according to a rotated angle of the valve plate around a rotary shaft, wherein the actuator determines whether or not the valve plate is opened or closed by a logic predetermined according to driving information of a vehicle and then rotates the valve plate to open or close the confluence pipe, and wherein the actuator rotates the valve plate to open the sub-entry confluence tube, in a fourth condition in which an engine is rotated at a constant speed within a third rotation range and an engine load is higher than a predetermined load within a third load range, or in a fifth condition in which the engine is rotated at a speed higher than a predetermined speed within a second rotation range and the engine load is lower than a predetermined load within a fourth load range.

2. The exhaust pipe structure according to claim 1, wherein the valve plate:

has the disc shape; and is configured to select one of the entry confluence tube and the sub-entry confluence tube as a path of the confluence pipe according to the rotated angle of the valve plate around the rotary shaft.

3. The exhaust pipe structure according to claim 1, wherein the actuator rotates the valve plate to close an inside of the confluence pipe, in a first condition in which the engine is rotated at a speed lower than a predetermined speed within a first rotation range, or in a second condition in which the engine is rotated at a speed higher than a predetermined speed within a second rotation range and the engine load is higher than a predetermined load within a first load range.

4. The exhaust pipe structure according to claim 1, wherein the actuator rotates the valve plate to open the entry confluence tube, in a third condition in which the engine is rotated at a constant speed within a third rotation range and the engine load is lower than a predetermined load within a second load range.

5. The exhaust pipe structure according to claim 1, wherein the first pipe and the second pipe each have sections disposed in parallel in front of mufflers; and the confluence pipe is disposed at the parallel sections of the first and second pipes.

* * * * *